US005143140A

United States Patent [19]

Melillo et al.

[11] Patent Number: 5,143,140

[45] Date of Patent: Sep. 1, 1992

[54] SPRAY CASTING OF MOLTEN METAL

[75] Inventors: Thomas J. Melillo, East Haven; Michael A. D'Onofrio, Branford; W. Gary Watson, Cheshire; Sankaranarayanan Ashok, Bethany, all of Conn.

[73] Assignee: Olin Corporation, Chesire, Conn.

[21] Appl. No.: 663,509

[22] Filed: Mar. 4, 1991

[51] Int. Cl.[5] ..... B22D 23/00

[52] U.S. Cl. ..... 164/46; 164/429; 164/479; 118/301

[58] Field of Search ..... 164/46, 429, 479; 427/422; 118/300, 301, 326

[56] References Cited

U.S. PATENT DOCUMENTS 2,733,172 1/1956 Brennan ..... 118/301
2,872,339 2/1959 Gabor ..... 118/301
3,670,400 6/1972 Singer ..... 164/479

FOREIGN PATENT DOCUMENTS 92629 11/1922 Austria ..... 118/301
950568 10/1956 Fed. Rep. of Germany ..... 118/301
295053 12/1988 Japan ..... 164/46

*Primary Examiner*—Richard K. Seidel
*Attorney, Agent, or Firm*—Bruce E. Burdick; H. Samuel Kieser

[57] ABSTRACT

The apparatus and method for spray casting a spray of molten metal on a moving substrate. The leading edge of the spray pattern is deflected away from or into the spray pattern to eliminate the cooler and less dense particles of the leading edge from contacting the substrate. The deflector preferably has a surface of non-wetting material to prevent the build up of material thereon.

4 Claims, 2 Drawing Sheets

SPRAY CASTING OF MOLTEN METAL

BACKGROUND OF THE INVENTION

1. Field of the Invention

The present invention relates generally to the spray-deposited production of a product on a moving substrate by the process of spray casting and, more particularly, is concerned with an improved method and apparatus for spray casting to reduce porosity.

2. Description of the Prior Art

A commercial process for production of spray-deposited, shaped preforms in a wide range of alloys has been developed by Osprey Metals Ltd. of West Glamorgan, United Kingdom. The Osprey process, as it is generally known, is disclosed in detail in U.K. Pat. Nos. 1,379,261 and 1,472,939 and U.S. Pat. Nos. 3,826,301 and 3,909,921 and in publications entitled "The Osprey Preform Process" by R.W. Evans et al, Powder Metallurgy, Vol. 28, No. 1 (1985), pages 13–20 and "The Osprey Process for the Production of Spray-Deposited Roll, Disc, Tube and Billet Preforms" by A.G. Leatham et al, Modern Developments in Powder Metallurgy, Vols. 15–17 (1985), pages 157–173.

The Osprey Process is essentially a rapid solidification technique for the direct conversion of liquid metal into shaped preforms by means of an integrated gas-atomizing/spray-depositing operation. In the Osprey process, a controlled stream of molten metal is poured into a gas-atomizing device where it is impacted by high-velocity jets of gas, usually nitrogen or argon. The resulting spray of metal particles is directed onto a "collector" where the hot particles re-coalesce to form a highly dense preform. The collector is fixed to a performing mechanism which is programmed to perform a sequence of movements within the spray, so that the desired preform shape can be generated. The preform can then be further processed, normally by hot-working, to form a semi-finished or finished product.

The Osprey process has also been proposed for producing strip or plate or spray-coated strip or plate, as disclosed in European Pat. Appln. No. 225,080. For producing these products, a substrate or collector, such as a flat substrate or an endless belt is moved continuously through the spray to receive a deposit of uniform thickness across its width.

Heretofore, extensive porosity typically has been observed in a spray-deposited preform at the bottom thereof, the bottom being its side in contact with the substrate or collector. This well known phenomenon, normally undesirable, is a particular problem in a thin gauge product, such as strip or tube, since the porous region may comprise a significant percentage of the product thickness. The porosity is thought to occur when the initial deposit layer is cooled too rapidly by the substrate providing insufficient liquid to feed the inherent interstices between splatted droplets.

Another defect feature often associated with this substrate region is extensive lifting of initial splats which promotes a non-flat surface. The lifting of the splats is a consequence of solidification contraction and distortion arising from the rapid solidification of the splats.

One approach of the prior art for eliminating these problems is preheating the substrate to minimize or reduce the rate of heat transfer from the initial deposit to the substrate so that some fraction liquid is always available to feed voids created during the spray deposition process. However, it is often difficult to effectively preheat a substrate in a commercial spray deposit system because of the cooling effects of the high velocity recirculating atomizing gas. Further, preheating a substrate increases the potential for the deposit sticking to the substrate.

Other approaches have been proposed for eliminating the porosity problem particularly in thin gauge product produced by the above described spray atomization process. Such approaches include the selection of particular materials for the substrate as exemplified in U.S. Pat. Nos. 4,917,170, 4,938,278 and 4,945,973. U.S. Pat. No. 4,966,224 shows a spray-depositing apparatus in which the substrate is orientated to provide that the particles of the leading edge of the spray travel the same or a less distance as the particles in the center to help reduce porosity. U.S. Pat. Nos. 4,901,784 and 4,907,639 describe asymmetrical gas atomizing devices for use in a gas-atomizing spray-depositing apparatus in which the leading edge of the spray pattern travels a shorter distance to the substrate to provide for a higher fraction of liquid in the initial deposits. U.S. Pat. No. 4,926,927 discloses a gas-atomizing spray-deposition apparatus in which overspray is prevented from becoming entrained in the product being formed.

SUMMARY OF THE INVENTION

In accordance with the present invention, a method and apparatus have been provided for reducing the bottom side porosity of a spray cast product. This may be accomplished through the provision of a molten metal spray-deposition apparatus comprising means for atomizing stream of molten metal into metal particles in a divergent spray pattern and deposit receiving means movable along a path having an area thereon disposed below the atomizing means for receiving a deposit of the particles in a spray pattern to form a product thereon. Means are provided for deflecting a portion of the leading edge of the spray pattern away from or back into the spray pattern.

According to the process of the present invention, a method of spray depositing a product on the moving substrate comprises atomizing a stream of molten metal into metal particles in a divergent spray pattern and depositing the particles on a movable substrate passing under the position to receive the molten metal particles. A portion of the leading edge of the spray pattern is deflected away from or back into the spray pattern.

BRIEF DESCRIPTION OF THE DRAWINGS

The present invention will be better understood by reference to the following detailed description and to the accompanying drawings in which.

DETAILED DESCRIPTION OF THE INVENTION

Figure 1:
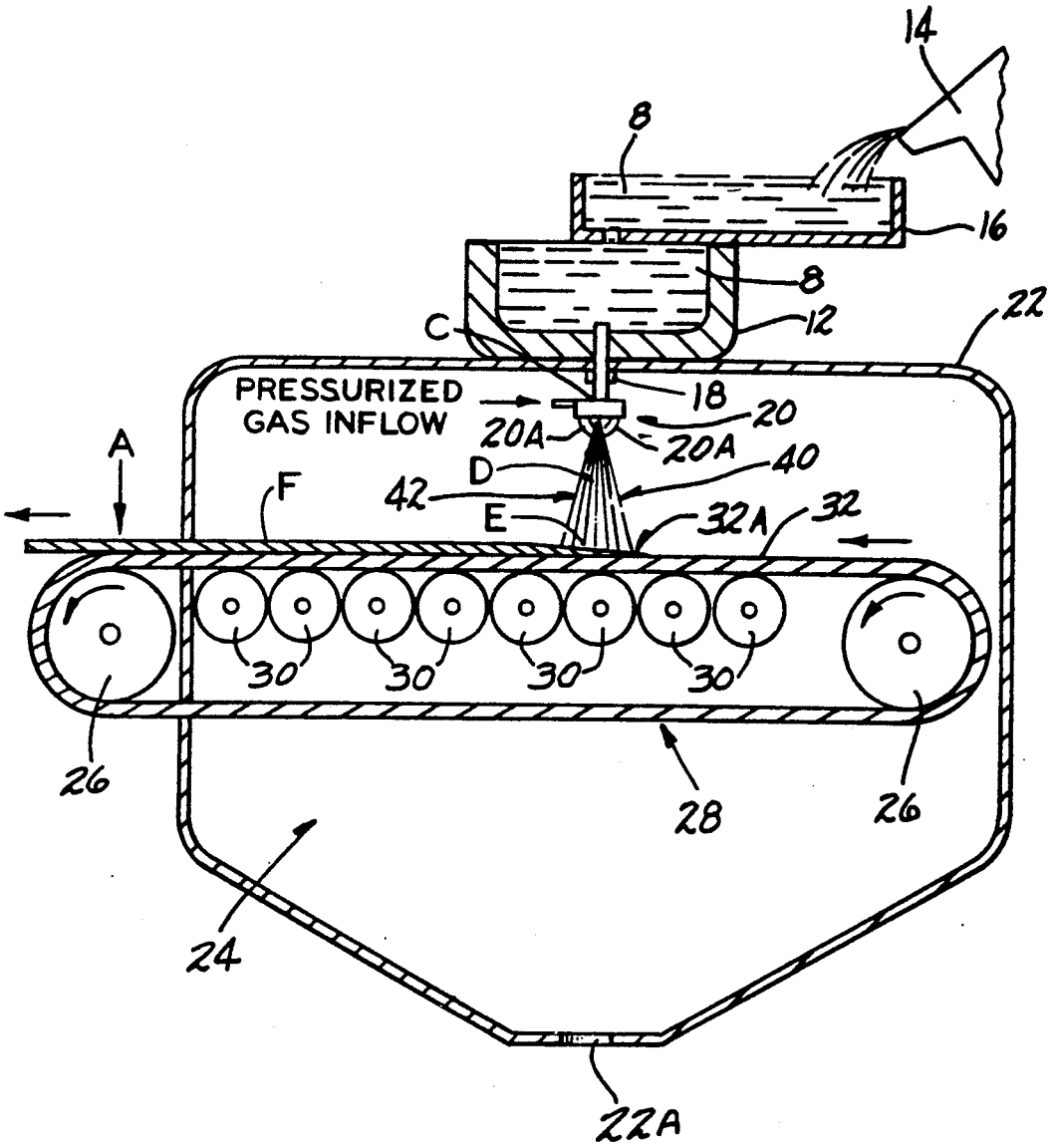
FIG. 1 is a schematic view, partly in section, of a spray-deposition apparatus which may be used for practicing the present invention.

Referring now to the drawings, and particularly to FIG. 1, there is schematically illustrated a spray-deposition apparatus, generally designated by the numeral 10, being adapted for continuous formation of products. An example of a product A is a thin gauge metal strip. One example of a suitable metal B is a copper alloy.

The spray-deposition apparatus 10 employs a tundish 12 in which the metal B is held in molten form. The tundish 12 receives the molten metal B from a tilaable melt furnace 14, via a transfer launder 16, and has a bottom nozzle 18 through which the molten metal B issues in a stream C downwardly from the tundish 12. A gas atomizing device 20 is positioned below the tundish bottom nozzle 18 within a spray chamber 22 of the apparatus 10.

The atomizer 20 is supplied wtth a gas under pressure from any suitable source. The gas serves to atomize the molten metal alloy and also supplies a protective atmosphere to prevent oxidation of the atomized droplets. The gas should preferably not react with the molten alloy. A most preferred gas is nitrogen. The nitrogen should have a low concentration of oxygen to avoid the formation of undesirable oxides. An oxygen concentration under about 100 ppm and preferably less than about 10 ppm is desirable.

The atomization gas is impinged against the molten alloy stream under pressure producing droplets having a specific mean particles size. However, an empirical measurement of the pressure does not permit control of droplet size. As the diameter of the molten stream of the metal increases, a given pressure of gas will supply proportionally less energy to break up the droplets. A more useful measurement of the effect of the impinging gas on the stream is the gas to metal ratio which is typically expressed in terms of cubic meters of gas per kilograms of metal.

Conventional spray casting operates at a gas to metal ratio of about 0.24 $m^3/kg$ to about 0.44 $m^3/kg$ and produces droplets having various diameters but predominantly in the range of from about 150 to about 250 microns.

The atomizer 20 surrounds the molten metal stream C and has a plurality of jets 20A positioned about the stream C which impinge the gas on the stream C so as to convert the stream into a spray D comprising a plurality of atomized molten droplets. The droplets are broadcast downward from the atomizer 20 in the form of a divergent conical pattern. If desired, more than one atomizer 20 may be used. The atomizer(s) 20 may be moved in a desired pattern for a more uniform distribution of the molten metal particles.

A continuous substrate system 24 is employed by the apparatus 10 and extends into the spray chamber 22 in generally horizontal fashion and in spaced relation below the gas atomizing device 20. The substrate system 24 may include drive means in the form of a pair of spaced rolls 26, an endless substrate 28 in the form of a flexible belt entrained about and extending between the spaced rolls 26, and support means in the form of a series of rollers 30 which underlie and support an upper run 32 of the endless substrate 28. The substrate 28 is composed of a suitable material, such as stainless steel or, copper or steel foil. An area 32A of the substrate upper run 32 directly underlies the divergent pattern of spray D for receiving thereon a deposit E of the atomized metal particles to form the metal strip product F.

The divergent spray pattern D, in relation to the upper run 32 of the substrate 28, has a leading or upstream edge 40 and a downstream or trailing edge 42. The particles in the leading edge 40 contact the moving substrate 28 in the deposit area 32A before the particles in the intermediate and trailing edge 42.

Figure 2:
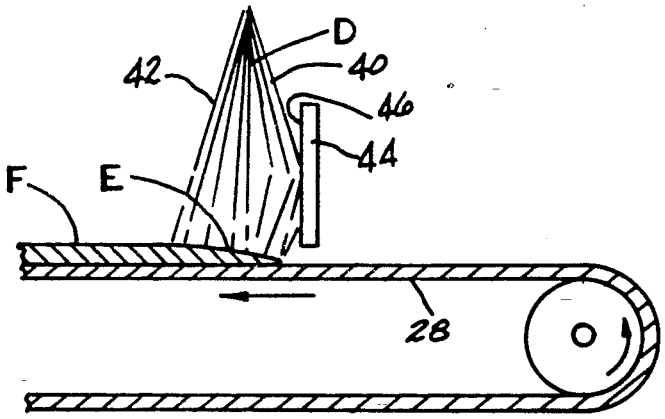
FIG. 2 is an enlarged fragmentary schematic sectional view of a portion of a spray-deposition apparatus incorporating one form of the present invention.

Referring to FIG. 2, in accordance with one embodiment of the present invention, a deflector 44 is stationarily mounted in a position such that it is contacted by the leading edge 40 of the spray D, so that a portion of the leading edge 40 of the spray D is deflected downstream toward the interior or center portion of the spray D.

The deflector 44 may be a plate of suitable material mounted within the spray chamber 22 in a stationary position and having a forward face 46 facing the spray D and lying in a plane substantially perpendicular to the plane of the deposit area 32A of the substrate 28.

The forward face of the deflector 44 is preferably fabricated from a material which will not be wet by the material in the spray pattern D to prevent a build up of a deposit on the deflector 44. Such a build up is undesirable because particles may become detached therefrom and become incorporated in the deposited material on the substrate and produce defects. Typical non-wetting materials suitable for use as the deflector face 46 for casting copper include teflon, graphite, boron nitride. These materials may be provided as a coating on a backing material or the entire deflector may be fabricated from them.

With the arrangement shown in FIG. 2, the particles of the leading edge 40 of the spray D are deflected downstream back into the spray such that they become intermixed with the powder particles of the spray. This results in the initial deposit being formed from particles having a higher mass density and which are hotter than if the particles in the leading edge are allowed to directly impinge upon the substrate.

Figure 3:
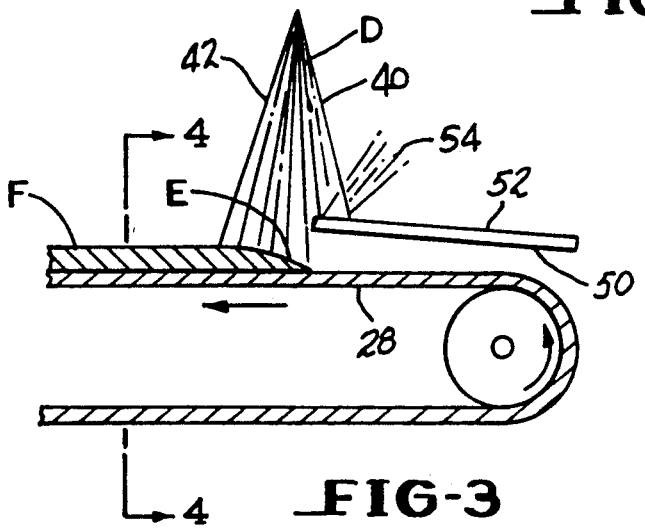
FIG. 3 is an enlarged fragmentary schematic sectional view of a portion of a spray-deposition apparatus incorporating a second form of the present invention.

FIG. 3 shows another embodiment of the invention wherein a deflector 50 is positioned such that its planar face 52 is inclined slightly upwardly with respect to the horizontal in a direction upstream of the substrate such that the leading edge 40 of the spray D contacts the planar face 52 of the deflector 50 and the particles thereof are deflected away from the spray pattern D in an upstream direction as overspray. The deflector 50 may be stationarily mounted within the spray chamber 22 and is preferably fabricated from a suitable non-wetting material as described above. The substrate system 28 should be so positioned that the upstream portion of the substrate 28 does not extend beyond the deflector 50 so the deflected particles 54 do not impact on the substrate 28 and become part of the deposited product.

Figure 4:
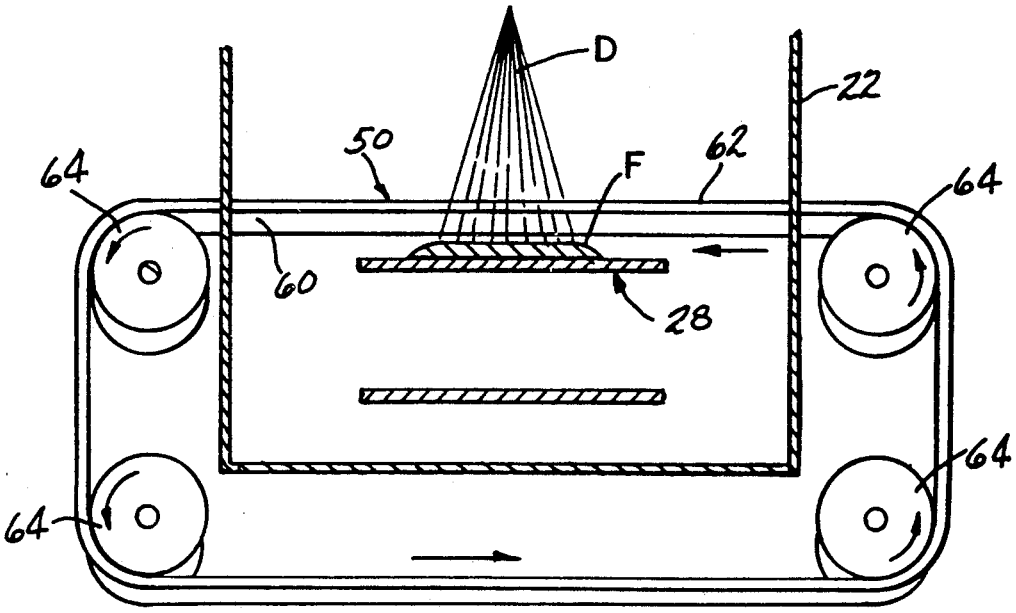
FIG. 4 is a front view of the apparatus of FIG. 3, taken along the lines 4—4 of FIG. 3.

Rather than being stationarily mounted, the deflector 50 may be in the form of an endless belt 60 as shown in FIG. 4. According to this arrangement, the deflector belt 60 moves through the leading edge of the spray D and out of one side of the chamber 22 and re-enters the chamber 22 at the opposite side. With this arrangement, it is possible to remove any material which might have adhered to the deflector 50 at a position outside the chamber 22 before that portion of the belt deflector re-enters the spray chamber 22. In accordance with this arrangement, the deflector belt 60 may be mounted on a suitable series of rolls 64 anyone of which may be driven to provide the proper path for the travel of the deflector belt 60 in the direction indicated by the arrow in FIG. 4. The plane of the upper surface 62 of the belt deflector 60 as it passes through the leading edge 40 of the spray pattern D should be inclined in the manner shown in FIG. 3 to deflect the particle in the leading edge away from the spray pattern and substrate.

With both of the arrangements shown in FIGS. 3 and 4, the cooler and less dense particles of the leading edge of the spray pattern D are prevented from being deposited on the substrate such that the temperature of the particles forming the initial deposit results in a higher fraction of liquid in the initial deposits promoting more even temperature distribution through the cross section of the deposits and minimizing porosity in the bottom surface thereof.

As the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents, and other publications cited herein are incorporated by reference in their entirety.

What is claimed is:

1. A molten metal spray-deposition apparatus comprising:

(a) a spray chamber;

(b) means for atomizing a stream of molten metal into metal particles and delivering the atomized stream into said spray chamber in a divergent spray pattern, (c) deposit receiving means movable along a path and having an area thereon disposed below said atomizing means for receiving a deposit of said particles in said spray pattern to form a product on said movable means, said spray pattern having a leading edge portion which is upstream of the deposit receiving means relative to the remainder of the spray pattern, (c) an endless belt having a path through the leading edge of the spray pattern and out of and back into said chamber for deflecting a portion of the leading edge of the spray pattern away from or into the spray pattern.

2. A process for spray casting molten metal comprising:

(a) atomizing a spray of molten metal into metal particles in a divergent spray pattern, (b) moving a substrate along a path so an area thereon is disposed below the atomizing means for receiving a deposit of said particles in said spray pattern to form a product, and (c) deflecting a portion of the leading edge of the spray pattern away from the center of the spray pattern into a position to avoid contact with said substrate.

3. The process of claim 2 wherein the leading edge is deflected by moving a deflecting surface through the leading edge of said spray pattern.

4. The process of claim 3 wherein a spray chamber is provided in which said means for atomizing is mounted, said process including moving said deflector surface along a path through the leading edge of the spray pattern and out of and back into said chamber.

* * * * *